US011274480B2

(12) United States Patent
Minter et al.

(10) Patent No.: US 11,274,480 B2
(45) Date of Patent: Mar. 15, 2022

(54) SLIDING DOOR ROLLER AND METHOD OF INSTALLATION

(71) Applicant: Interlock USA, Inc., Reno, NV (US)

(72) Inventors: Peter J. Minter, Reno, NV (US); Jacob Baitx, Reno, NV (US)

(73) Assignee: INTERLOCK USA, INC., Reno, NV (US)

( * ) Notice: Subject to any disclaimer, the term of this patent is extended or adjusted under 35 U.S.C. 154(b) by 0 days.

(21) Appl. No.: 17/085,622

(22) Filed: Oct. 30, 2020

(65) Prior Publication Data

US 2021/0131157 A1 May 6, 2021

Related U.S. Application Data

(60) Provisional application No. 62/927,761, filed on Oct. 30, 2019.

(51) Int. Cl.
*E05D 15/06* (2006.01)

(52) U.S. Cl.
CPC ..... *E05D 15/0634* (2013.01); *E05D 15/0669* (2013.01); *E05Y 2201/10* (2013.01); *E05Y 2201/638* (2013.01); *E05Y 2201/688* (2013.01); *E05Y 2800/268* (2013.01); *E05Y 2800/29* (2013.01); *E05Y 2900/132* (2013.01)

(58) Field of Classification Search
CPC ..... Y10T 16/381; Y10T 16/3816; Y10T 16/3834; Y10T 16/3837; E05D 15/0634; E05D 15/0647; E05D 15/0669; E05D 15/0682; E05Y 2201/10; E05Y 2201/638; E05Y 2201/688; E05Y 2900/132; E05Y 2800/268; E05Y 2800/29
See application file for complete search history.

(56) References Cited

U.S. PATENT DOCUMENTS 215,993 A 5/1879 Townsend
2,494,347 A 1/1950 Matthews
(Continued)

FOREIGN PATENT DOCUMENTS

CN 2416206 Y * 1/2001 ..... E05D 15/0669
CN 201598921 U * 10/2010
(Continued)

*Primary Examiner* — Chuck Y Mah
(74) *Attorney, Agent, or Firm* — DeLio Peterson & Curcio LLC; David R. Pegnataro

(57) ABSTRACT

A sliding door roller assembly includes a roller housing being at least partially disposed within an outer housing moveable relative to the roller housing and at least one roller wheel in a direction perpendicular to a rotational axis of the at least one roller wheel. At least one resilient member is positioned at an end of the outer housing, and includes a fixed termination section coupled to an end member of the outer housing, a compliant section extending from the fixed termination section, a curved engagement section, and a resilient section between the compliant section and the curved engagement section and pivotable about the compliant section. The at least one resilient member is flexible from a first position to a second position when the curved engagement section mates with an inner surface of a slot defining a bottom edge of a panel secured to the outer housing to provide a holding force between the resilient member and the inner surface of the slot.

20 Claims, 11 Drawing Sheets

(56) References Cited

U.S. PATENT DOCUMENTS 3,237,238 A 1/1966 Anderson
3,284,953 A * 11/1966 Rifkin ..... E05D 15/0669 49/420
3,386,208 A * 6/1968 Banner ..... E05D 15/0669 49/420
3,443,340 A 5/1969 Helmick et al.
3,670,357 A * 6/1972 Steigerwald ..... E05D 15/0669 16/105
3,959,849 A 6/1976 Marquardt
3,996,643 A 12/1976 Steigerwald
4,014,073 A * 3/1977 Uehara ..... E05D 15/0669 16/105
4,134,178 A 1/1979 Stevens
4,194,266 A 3/1980 Natzel
4,262,451 A * 4/1981 Dallaire ..... E05D 15/0669 16/105
4,850,078 A 7/1989 Libby et al.
4,899,493 A 2/1990 Baumgarten
5,671,502 A * 9/1997 Ezman ..... E05D 15/0673 16/105
5,791,089 A 8/1998 Prevot et al.
5,924,885 A * 7/1999 Pacher ..... H01R 13/6273 439/352
5,950,279 A * 9/1999 Chaput ..... A47H 1/08 16/105
6,021,547 A 2/2000 Stagoll
6,526,625 B2 3/2003 Becken
6,588,061 B2 7/2003 Becken
7,770,329 B2 8/2010 Hutnik et al.
7,962,998 B2 6/2011 Proctor et al.
8,240,089 B2 8/2012 Lambertini
8,490,331 B2 7/2013 Quesada
8,881,460 B2 11/2014 Bouthillier
8,950,041 B2 2/2015 Palsson et al.
8,955,195 B2 2/2015 Chang et al.
8,984,716 B2 3/2015 Proctor et al.
9,068,385 B2 6/2015 Proctor et al.
9,080,359 B2 7/2015 Horwood
9,085,924 B2 7/2015 Tidwell
9,458,654 B2 10/2016 Palsson et al.
2001/0053736 A1* 12/2001 Becken ..... E05D 15/0669 492/16
2005/0011041 A1 1/2005 Ness
2005/0012816 A1 1/2005 Becken
2007/0017065 A1* 1/2007 Hutnik ..... E05D 15/0669 16/91
2014/0173991 A1 6/2014 Saunders et al.
2016/0138315 A1 5/2016 Kreyenborg et al.
2018/0283070 A1 10/2018 Hamilton et al.

FOREIGN PATENT DOCUMENTS

KR 101548874 B1 9/2015
KR 101956862 B1 6/2019
WO 2011061316 A1 5/2011
WO WO-2011100788 A1 * 8/2011 ..... E05D 15/0669

* cited by examiner

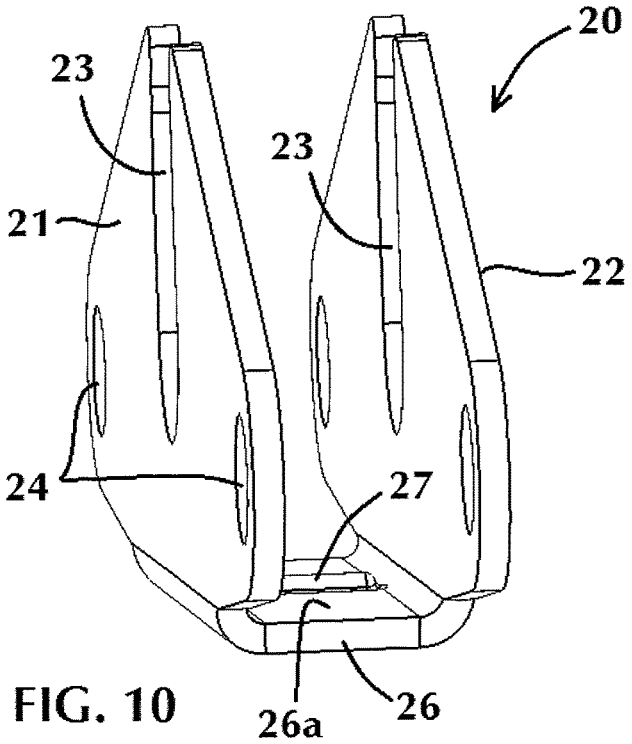
FIG. 10
FIG. 11
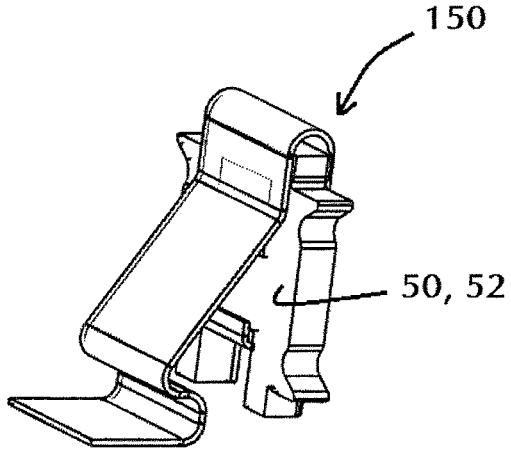
FIG. 12
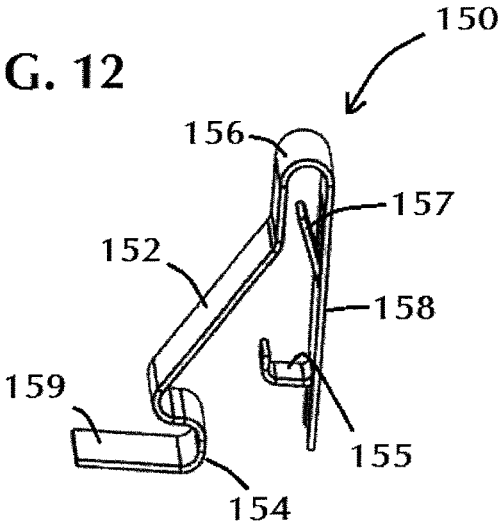
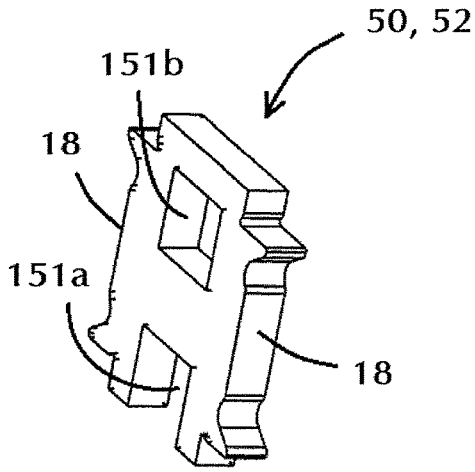
FIG. 13

FIG. 15
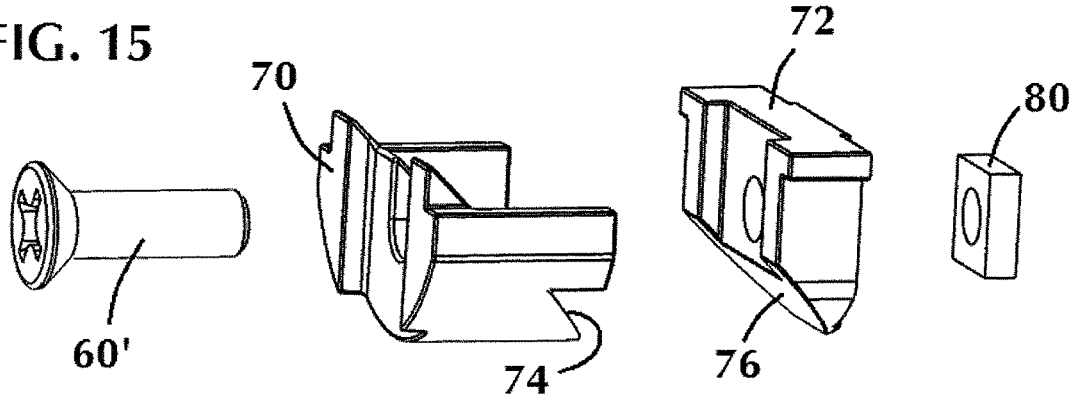
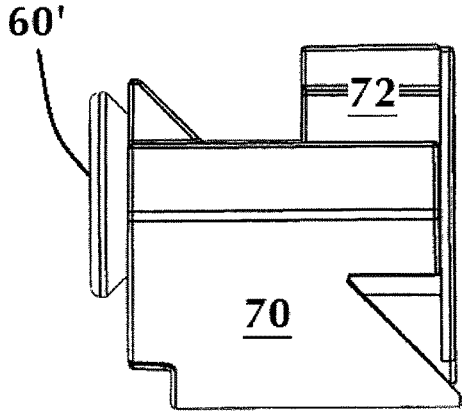
FIG. 16A
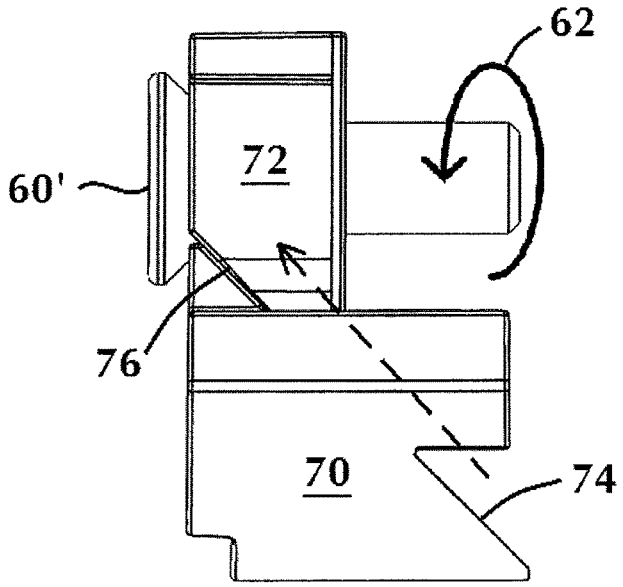
FIG. 16B

SLIDING DOOR ROLLER AND METHOD OF INSTALLATION

BACKGROUND OF THE INVENTION

1. Field of the Invention

The present invention relates generally to sliding door rollers. More specifically, the present invention relates to an improved adjustable sliding door roller for a multi-panel door, such as a multi-panel glass door. In an embodiment, the adjustable sliding door roller uses resilient spring clips to engage the backside of the profile wall after the roller is installed into the bottom sash routing, rather than conventional tab screws.

2. Description of Related Art

Sliding doors are used to provide ingress and egress from a building structure. Sliding doors having roller carriages allow the sliding door to slide on a track in the sill. Such door roller systems typically include a base or housing for supporting the door panel and one or more wheels or rollers coupled to the housing. Typically, door roller systems are adjustable to permit adjustment to the height or spacing of the housing relative to the wheels.

However, known door roller systems have several disadvantages. Most rollers require two screws be applied to the outer tabs of the roller housing to secure the roller housing to the bottom of the panel. These types of tabs are used on side-adjusting rollers and end-adjusting rollers and simply hold the roller in place until it gets installed into the frame and on a rail. The tabs do not support any weight and after installation the only function of the screws is to hold the roller inside the panel if it is lifted at a later time for service or to take weight off the panel for adjustment. Valuable installation time is thus spent on a feature which does not serve any purpose after assembly into the panel, and there is a further opportunity to reduce complexity of manufacture.

Therefore, there is a need for an improved sliding door roller system which reduces complexity of manufacture and installation time.

SUMMARY OF THE INVENTION

Bearing in mind the problems and deficiencies of the prior art, it is therefore an object of the present invention to provide an improved sliding door roller system which allows for adjustment of the height or spacing of the outer housing relative to the track or rail while under load.

It is another object of the present invention to provide an improved outer housing for use in a sliding door roller system which allows for higher load capability and rigidity under full load of the door panel.

A further object of the present invention is to provide an improved siding door roller system which simplifies manufacture and reduces installation time by eliminating unnecessary components.

Still another object of the present invention is to provide an improved method of assembling a sliding door roller to a door panel.

Still other objects and advantages of the invention will in part be obvious and will in part be apparent from the specification.

The above and other objects, which will be apparent to those skilled in the art, are achieved in the present invention which is directed to a sliding door roller assembly comprising a roller housing comprising a pair of generally vertical side members and at least one roller wheel is rotatably coupled to the roller housing, and being at least partially disposed within an outer housing moveable relative to the roller housing and the at least one roller wheel in a direction perpendicular to a rotational axis of the at least one roller wheel. At least one resilient member is positioned at an end of the outer housing, and includes fixed termination section coupled to an end member of the outer housing, a compliant section extending from the fixed termination section, a curved engagement section for mating with an inner surface of a slot defining a bottom edge of a panel secured to the outer housing, and a resilient section between the compliant section and the curved engagement section and pivotable about the compliant section. The at least one resilient member being flexible from a first position to a second position when the curved engagement section mates with an inner surface of the slot to provide a holding force between the resilient member and the inner surface of the slot to maintain the roller within the slot. A rotatable adjustment mechanism is coupled to the roller housing and the outer housing, and is rotatable from an exterior of the outer housing and adapted to adjust a height of the outer housing relative to the roller housing in a plurality of height positions in situ under load of the panel.

The at least one resilient member may include a lip extending from the fixed termination section for coupling the resilient member to a first recessed portion of the end member of the outer housing, and a resilient flange angled toward the compliant section for coupling the resilient member to a second recessed portion of the end member of the outer housing. The at least one resilient member resilient section may extend from the compliant section at an approximately 45-degree angle when the at least one resilient member is in the first position. A substantially planar flange may extend from the resilient member curved engagement section in a direction away from the fixed termination section.

In an embodiment, the adjustment mechanism may comprise a rotatable control member and a non-circular cam coupled to a gear wheel, the cam being in rotatable communication with the control member and rotatable about an axis transverse to the roller housing vertical side members and having a peripheral edge comprising a plurality of teeth. The cam teeth cooperate with a projection on an inner surface of a base portion of the roller housing to index the outer housing relative to the roller housing in a plurality of height positions as a result of rotation of the cam. The cam peripheral edge defines an increasing radius from a first position along the cam peripheral edge to a second position along the cam peripheral edge, wherein rotation of the cam from about the first position towards the second position indexes the outer housing away from the inner housing, and wherein rotation of the cam from about the second position towards the first position indexes the outer housing towards the inner housing. The roller housing inner surface projection acts as a detent to prevent rotation of the cam while under load of the panel.

The roller housing may comprise a vertical channel extending through a portion of each side member, wherein the adjustment mechanism control member extends between the side members and is translatable within the channel as the outer housing is indexed relative to the roller housing as a result of rotation of the cam. The rotatable control member extends through apertures in the respective major surfaces of the vertical shell members, and is rotatable from an exterior of the outer housing to rotate the cam and gear wheel to index the outer housing relative to the roller housing.

The outer housing may comprise a pair of generally vertical shell members, each shell member having a flange on an upper edge thereof extending in the direction of the opposing shell member, with at least a portion of the shell member flanges being keyed or interlocking to form a plane perpendicular to respective major surfaces of the vertical shell members. The plane may comprise a slot between the vertical shell member interlocking flanges and extending along a portion of a longitudinal axis of the outer housing.

In another embodiment, the adjustment mechanism may comprise a rotatable control member extending through a pair of angled members having complementary ramped mating surfaces disposed within the outer housing, the rotatable control member coupled to an internally threaded component disposed within a recess in a rear surface of one of the angled members, such that the internally threaded component causes said angled member to be drawn toward the opposing angled member when the rotatable control member is rotated in a first direction, the complementary mating surfaces cooperating to translate the outer housing relative to the roller housing in a plurality of height positions as a result of rotation of the control member.

In another aspect, the present invention is directed to a method of assembling a sliding door roller to a panel. The method comprises the steps of providing a sliding door roller assembly as described above; providing the panel having a bottom edge defining a routing for the sliding door roller assembly, the routing including a slot having an inner surface with opposing edges; inserting the sliding door roller within the panel slot to mate the curved engagement section of the sliding door roller at least one resilient member with one of the slot inner surface opposing edges; while inserting, causing the at least one resilient member to flex from the first position to the second position to generate a holding force between the resilient member and the inner surface of the slot in a direction transverse to an axial insertion direction of the sliding door roller assembly; and releasing the sliding door roller assembly so that the holding force acts on the resilient member to maintain the sliding door roller assembly within the panel routing.

The step of inserting the sliding door roller within the panel slot may further comprise permitting limited misalignment of the sliding door roller assembly on an axis perpendicular to a longitudinal axis of the panel. The step of flexing the at least one resilient member from the first position to the second position may further comprise moving the at least one resilient member curved engagement section in a direction which is substantially perpendicular to a longitudinal axis of the resilient member; and causing the resilient section to pivot about the compliant section.

The method may further include rotating the adjustment mechanism from the exterior of the outer housing to translate the outer housing relative to the roller housing from a first height position to a second height position, the second height position being different from the first height position.

In an embodiment, the adjustment mechanism may comprise a rotatable control member and a non-circular cam coupled to a gear wheel, the cam in rotatable communication with the control member and rotatable about an axis transverse to the roller housing vertical side members, the cam having a peripheral edge comprising a plurality of teeth, the cam teeth cooperating with a projection on an inner surface of a base portion of the roller housing to index the outer housing relative to the roller housing in a plurality of height positions as a result of rotation of the cam, and the step of rotating the adjustment mechanism may further comprise rotating the control member and cam to index the outer housing relative to the roller housing. The cam peripheral edge defines an increasing radius from a first position along the cam peripheral edge to a second position along the cam peripheral edge, wherein rotation of the cam from about the first position along the cam peripheral edge towards the second position along the cam peripheral edge indexes the outer housing away from the inner housing to the second height position, the second height position being greater than the first height position; and wherein rotation of the cam from about the second position along the cam peripheral edge towards the first position along the cam peripheral edge indexes the outer housing towards the inner housing to the second height position, the second height position being lower than the first height position.

The roller housing inner surface projection may act as a detent to prevent rotation of the cam while under load of the panel, and the method may further comprise the step of locking the outer housing in a desired height position relative to the roller housing by engaging one or more of the cam teeth with the roller housing inner surface projection.

In another embodiment, the adjustment mechanism may comprise a rotatable control member extending through a pair of angled members having complementary ramped mating surfaces disposed within the outer housing, the rotatable control member coupled to an internally threaded component disposed within a recess in a rear surface of one of the angled members, such that the internally threaded component causes said angled member to be drawn toward the opposing angled member when the rotatable control member is rotated in a first direction, the complementary mating surfaces cooperating to translate the outer housing relative to the roller housing in a plurality of height positions as a result of rotation of the control member, and the step of rotating the adjustment mechanism may further comprise causing the one of the angled members to be drawn toward a top of the mating ramped surface of the opposing angled member to translate the outer housing relative to the roller housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 10 is a perspective view of the roller housing of the sliding door roller of FIG. 1.

FIGS. 11 to 13 are perspective views of an embodiment of the mounting tab and spring clip of the sliding door roller of the present invention.

FIG. 15 is an exploded perspective view of another embodiment of the height adjustment mechanism of the sliding door roller of the present invention.

FIGS. 16A-16B are side plan views of the embodiment of the height adjustment mechanism of FIG. 15, in a fully lowered state (FIG. 16A) and a fully extended state (FIG. 16B).

DESCRIPTION OF THE EMBODIMENT(S)

Figure 1:
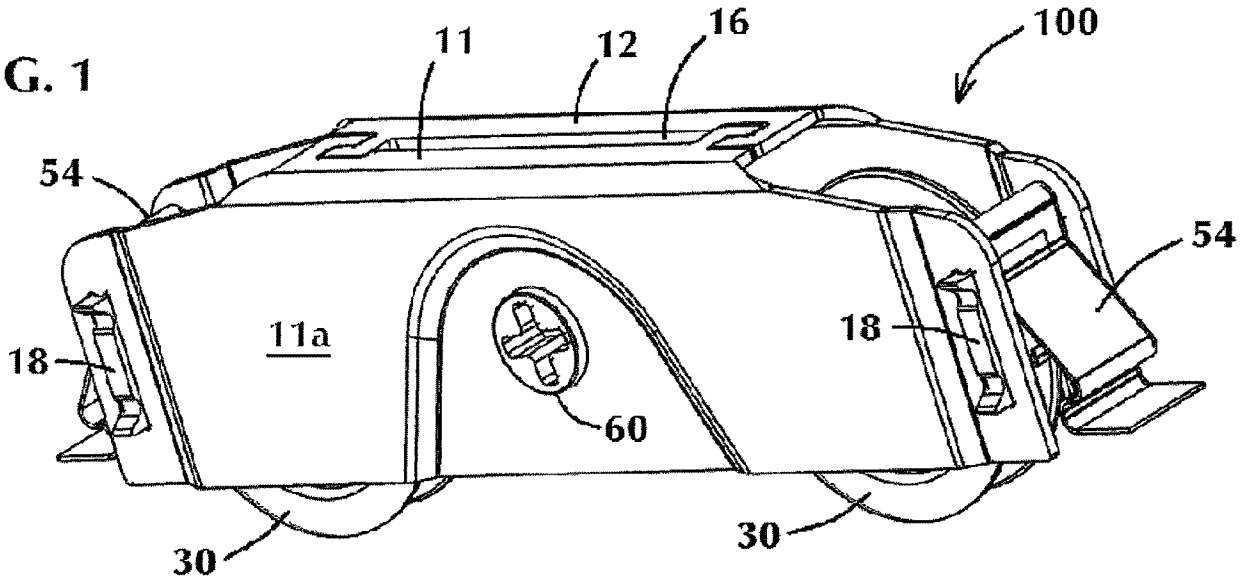
FIG. 1 is a perspective view of one embodiment of the sliding door roller of the present invention, shown in a fully lowered state.

In describing the embodiments of the present invention, reference will be made herein to FIGS. 1-22 of the drawings, in which like numerals refer to like features of the invention.

Certain terminology is used herein for convenience only and is not to be taken as a limitation of the invention. For example, words such as "upper," "lower," "left," "right," "horizontal," "vertical," "upward," "downward," "clockwise," "counterclockwise," "longitudinal," "lateral," "radial," or variants thereof, merely describe the configuration shown in the drawings. Indeed, the referenced components may be oriented in any direction and the terminology, therefore, should be understood as encompassing such variations unless specified otherwise. For purposes of clarity, the same reference numbers will be used in the drawings to identify similar elements.

Additionally, in the subject description, the words "exemplary," "illustrative," or the like are used to mean serving as an example, instance or illustration. Any aspect or design described herein as "exemplary" or "illustrative" is not necessarily intended to be construed as preferred or advantageous over other aspects or design. Rather, use of the words "exemplary" or "illustrative" is merely intended to present concepts in a concrete fashion.

One embodiment of the sliding door roller of the present invention is shown in FIGS. 1-14, inclusive. The sliding door roller is configured to allow for or assist in moving a door or window panel, such as a multi-panel glass door, along a track or other rail pathway. Unlike conventional roller systems, which require screws to be applied to the outer tabs of the housing to secure the roller to the panel, an embodiment of the roller of the present invention utilizes snap-on, resilient spring clips that engage the backside of the profile wall after being pushed into the bottom sash routing. Moreover, the roller of the present invention is adjustable while under load, to allow for changes in the height or spacing of the panel being supported by the roller with respect to the track. The roller generally includes a roller housing, at least one roller or wheel rotatably coupled to the roller housing, an outer housing securable within the panel via opposing spring clips, and an adjustment mechanism coupled to the roller housing and outer housing for adjusting the height of the outer housing with respect to the roller housing and track or rail.

Figure 2:
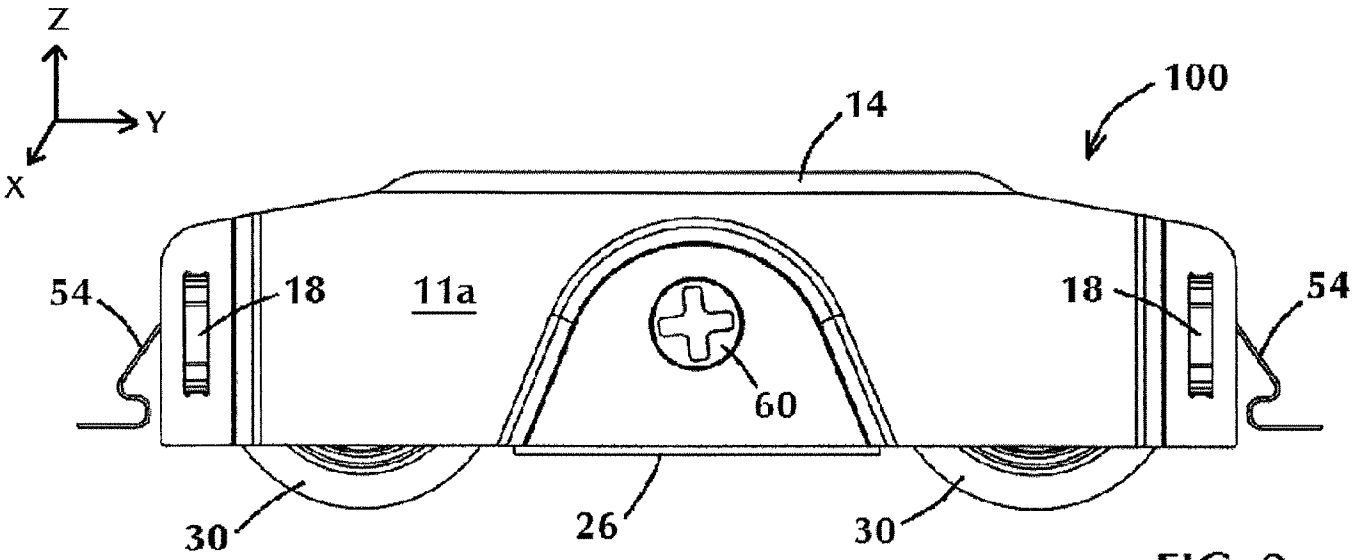
FIG. 2 is front, plan view of the sliding door roller of FIG. 1.
Figure 6:
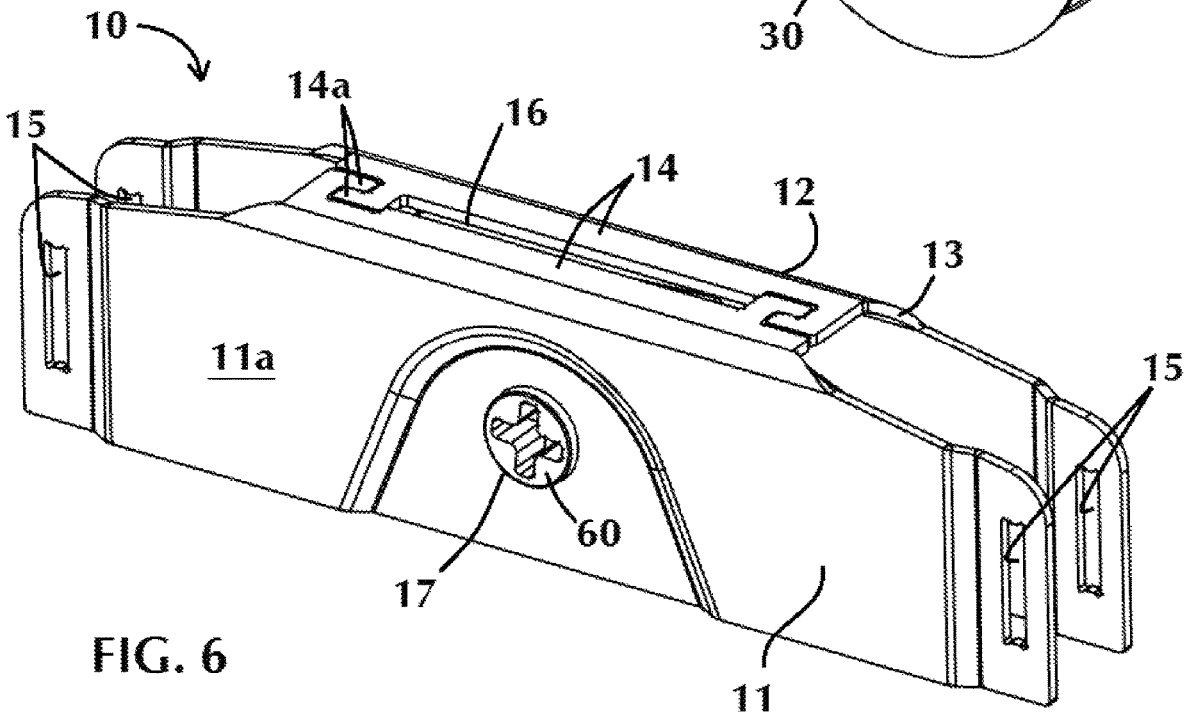
FIG. 6 is a perspective view of the outer housing of the sliding door roller of FIG. 1.

Referring now to FIG. 1, an illustrative embodiment of a sliding door roller 100 according to the present invention is shown. The roller assembly includes an outer housing or shell 10 (as best shown in FIG. 6) within which a roller housing or carriage 20 is at least partially disposed. As shown in FIG. 1, outer housing or shell 10 comprises a pair of generally vertical side members or shell members 11, 12 connected by non-integral end members 50, 52. The end members include tabs 18 that extend within slots 15 in the shell members, and are secured therein by known methods, such as riveting. Other methods of securing the end members 50, 52 to the shell members 11, 12 may also be used. In other embodiments, the end members may be integrally formed with the side members 11, 12 to form a unitary outer housing or shell 10. In contrast to rollers of the prior art, which require screws to be axially applied to longitudinally-extending outer tabs extending from the end members of the housing to secure the roller to the bottom of a door panel, one embodiment of the roller of the present invention utilizes snap-on resilient spring clips 150 on one or both ends of the housing that extend outwardly to engage the backside of the profile wall after being pushed into the bottom sash routing (FIGS. 1-2).

As shown in FIGS. 11-13, resilient spring clips 150 may be attached to end members 50, 52 in place of conventional screw tabs. In an illustrative embodiment, as shown in FIGS. 12-13, spring clips 150 may include an upwardly-curved lip 155 and a resilient flange 157 angled towards spring clip compliant section 156 for coupling the spring clip to recessed portions 151*a*, 151*b* of end members 50, 52. As the spring clip is pressed onto the top portion of end member 50, 52, flange 157 deflects towards termination section 158 as a result of contact with a rear face of end member 50, 52 to permit snap-on attachment of flange 157 to recess 151*b*, while the top surface of lip 155 contacts an inner portion of recess 151*a*, securing spring clip 150 to end member 50, 52, as shown in FIG. 11.

When installing the roller 100 into a sash routing in the bottom of a panel, resilient sections 152 of the spring clips 150 deform or deflect from a first position to a second position to provide a sufficient mating force between the spring clips and an inner surface of the sash routing to hold the roller in place. As the resilient deflection of the spring clips 150 occurs, the termination sections 158 of the spring clips remain in a fixed position with respect to end members 50, 52, and curved engagement sections 154 are moved in a direction which is essentially perpendicular to the longitudinal axis of the spring clips, causing the resilient sections 152 to pivot about the compliant section 156. In the embodiment shown, the resilient sections 152 extend from the compliant sections 156 at an essentially 45-degree angle, although other angles may be used. The rigidity of the compliant section 156 determines the mating force applied by the spring clips 150 to the sash routing (not shown). In one or more embodiments, an embossment may extend from the resilient section 152 to the termination section 158 to provide additional strength and stability to the compliant section 156. The shape, size and positioning of the embossments may be varied depending upon the amount of stiffness or resiliency of the contacts that is desired. In the embodiment shown, spring clips 150 are structured to engage the sash routing at a particular height and spacing; however, it should be understood by those skilled in the art that in other embodiments, one or both of spring clips 150 may comprise a "razor tooth"-type spring clip which allows for assembly into the sash routing at one of a plurality of different tab heights, for example, which provides for increased design flexibility.

During assembly of the roller into the bottom sash routing, spring clips 150 do not require manual compression by the installer, rather the resilient sections 152 of the spring clips are compressed against an inner surface of the sash routing or slit as the roller housing is assembled into the sash, creating the necessary mating force. An advantage of the present invention is that by having spring clips 150 on one or both ends of the roller assembly 100, the assembly does not need to be installed horizontally at a perfect 90-degree angle to the longitudinal axis (Z-axis) of the panel (FIG. 2) and respective angular movement of the roller assembly from the perpendicular direction is allowed to some degree. In other words, the resilient spring clips 150 permit limited misalignment of the roller on or about the X-axis, i.e. perpendicular to the longitudinal (Z) axis of the panel, during assembly of the roller to the bottom sash routing. The width of the sash routing will prevent misalignment about the Y-axis as the roller is assembled into the sash.

Moreover, the spring clip(s) 150 serve to automatically center the roller assembly within the routing during installation. As the resilient section 152 of the spring clip is compressed against an inner surface of the sash routing during installation, the resilient section is moved back toward the roller housing to allow the curved engagement section 154 to pass in front of an edge or lip of the opening of the sash routing or slit. Once the resilient section 152 clears the slit, the curved engagement section 154 performs its engagement function to engage the edge or lip of the sash routing. A substantially horizontal flange 159 extending from the curved engagement section 154 of the spring clip is thus flush with the bottom edge of the panel, centering the roller assembly within the routing.

In an embodiment of the present invention with a spring clip 150 on only one end of the roller assembly, the stationary end of the roller assembly can be inserted into the sash routing at any angle up to 90 degrees to the Z-axis of the panel and placed into approximate position in the routing slit, while the opposing end of the roller comprising the spring clip is then rotated towards the sash routing to compress the resilient section 152 of the spring clip against an inner surface of the sash routing, moving the resilient section back toward the roller housing to allow the curved engagement section 154 to pass in front of an edge or lip of the opening of the sash routing or slit, as described above. In contrast to rollers of the prior art, the roller assembly of the present invention allows for flush mounting with the bottom of the sash (not shown), with the center of rotation of the springs inside the sash profile, rather than at the bottom or outside of the profile.

Figure 3:
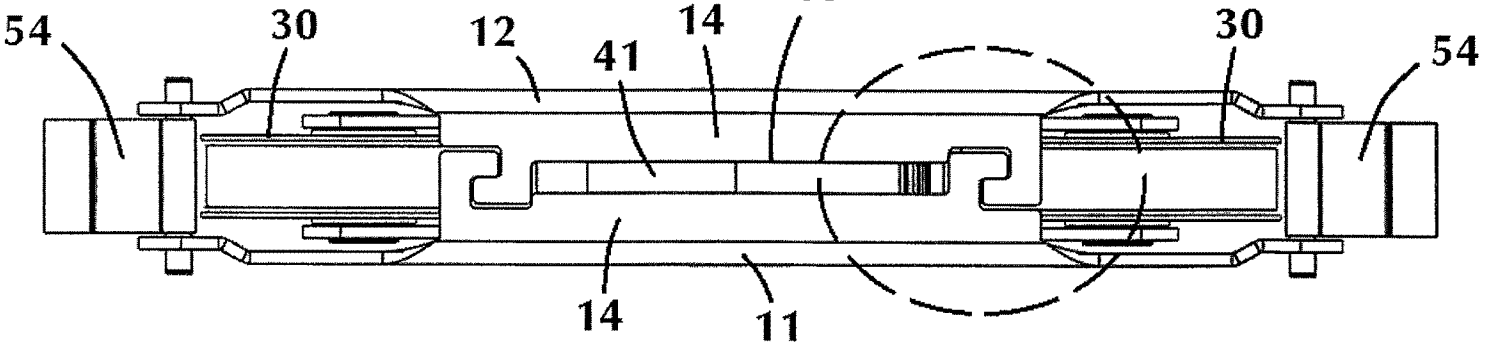
FIGS. 3 and 3A are a top plan view, and magnified view, respectively, of the sliding door roller with interlocking outer casing of FIG. 1.
Figure 3A:
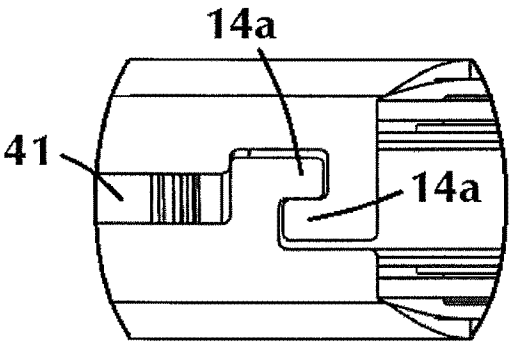

Referring now to FIG. 6, each shell member includes a flange 14 at a top edge 13 thereof that extends approximately perpendicular to the major surface 11*a*, 12*a* of each shell member in the direction of the opposing shell member. In contrast to conventional housings of rollers of the prior art, the flanges of the respective side members each have a keyed portion 14*a* or are otherwise interlocked to form a plane approximately perpendicular to the major surfaces of the respective shell members (FIGS. 3 and 3A). As shown in at least FIGS. 1, 3 and 6, the plane formed by the interlocking flanges may comprise a slot or opening 16 approximately centered between the pair of vertical side members 11, 12. The interlocking flanges provide higher rigidity of the outer housing or shell, and increased load capacity over roller systems of the prior art, when a panel is secured thereto.

Figure 5:
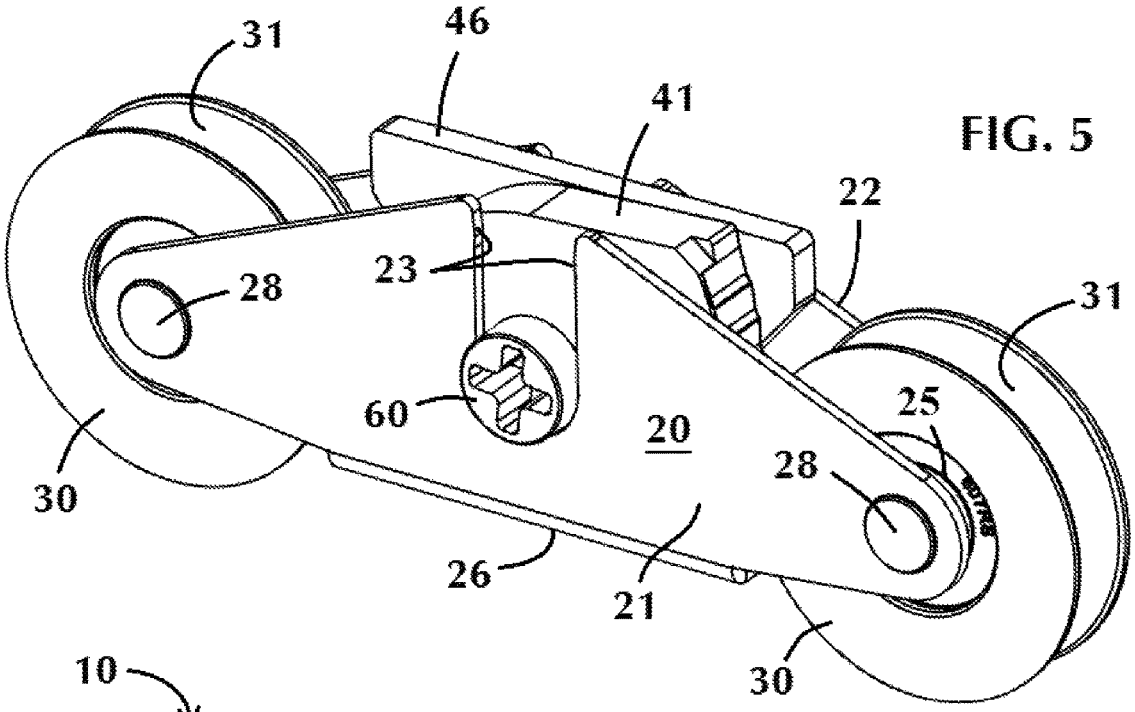
FIG. 5 is a perspective view of the roller housing and height adjustment mechanism of the sliding door roller of FIG. 1.
Figure 14A:
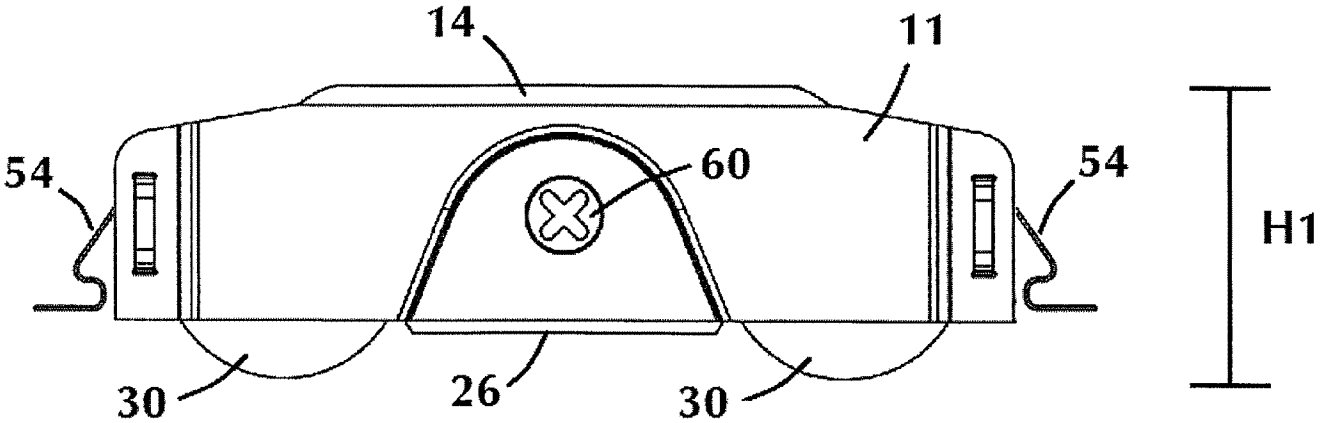
FIGS. 14A-14B are side plan views of an embodiment of the sliding door roller of the present invention, shown in a fully lowered state (FIG. 14A) and a fully extended state (FIG. 14B).
Figure 14B:
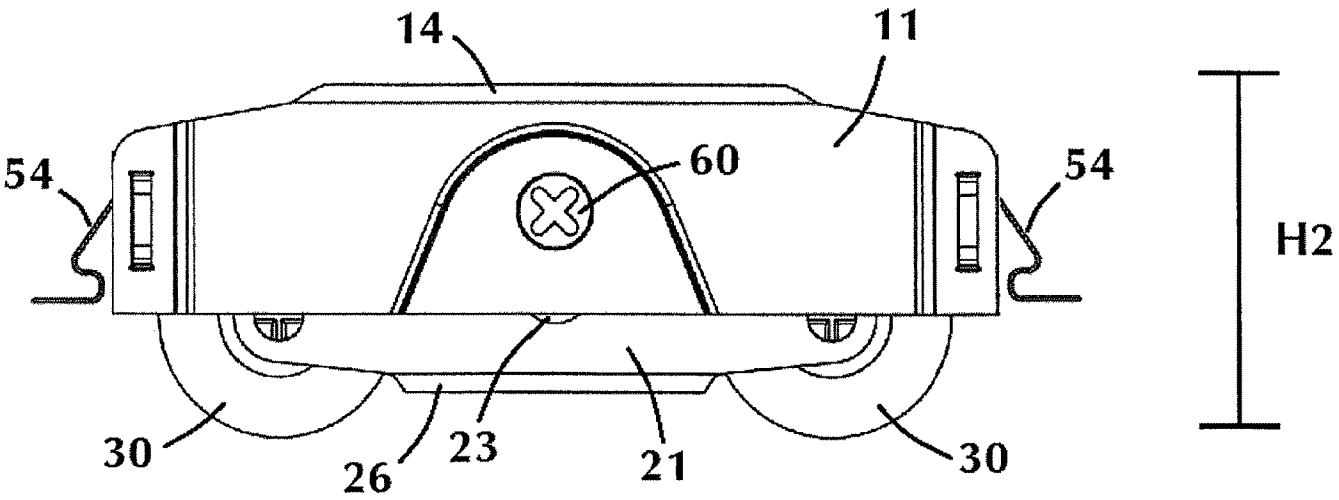

The roller of the present invention further includes an inner roller housing or carriage 20, within which at least one roller or wheel 30 is disposed, as shown in FIG. 5. Inner housing 20 is adjustable within and with respect to the outer housing 10 by a rotatable adjustment mechanism 40 coupled to the roller housing and outer housing, as will be described in more detail below. Such adjustment changes the height or spacing of the outer housing and door panel supported by the roller system, with respect to the track or rail (FIGS. 14A-14B).

Figure 4:
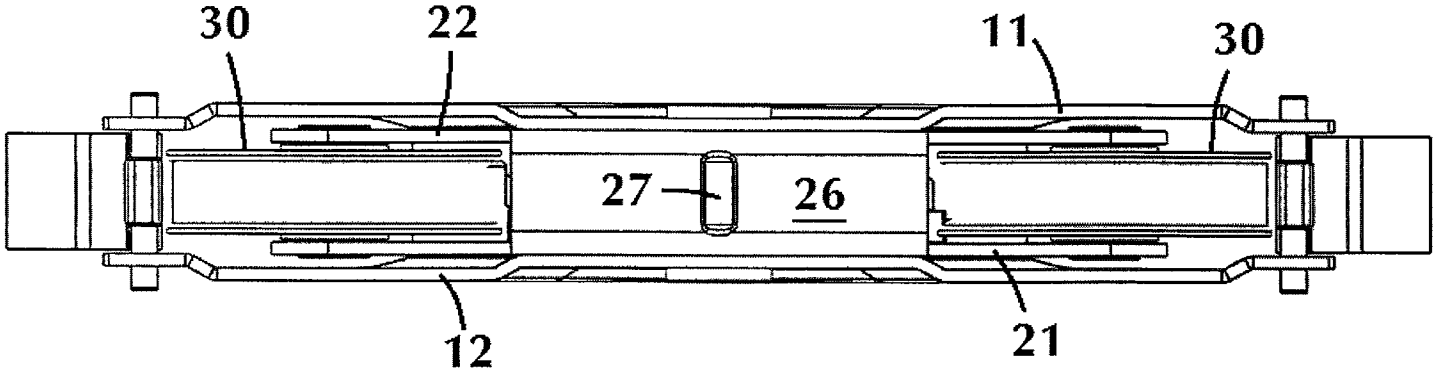
FIG. 4 is a bottom plan view of the sliding door roller of FIG. 1.

Roller housing or carriage 20 comprises a pair of generally vertical side members 21, 22 connected by an integral base portion 26. In contrast to roller systems of the prior art, which typically include a two (or more) piece roller housing, the inner housing of the present invention may be a one-piece housing forming a generally U-shape when viewed along an axis between the vertical side members. Base portion 26 includes a bump or projection 27 on an inner surface 26*a* thereof, at an approximate midpoint along the length of the base portion (FIGS. 4 and 10). In an embodiment, as best shown in FIG. 5, the inner housing side members 21, 22 may define obtuse triangular plates having rounded corners. Within each side member is a concave portion or channel 23 beginning at the obtuse angle of the side member and extending in the direction of the hypotenuse. A control member 60 extends within channel 23 and translates or moves vertically within the channel in response to actuation of an adjustment mechanism 40 to adjust the height or spacing of the panel with respect to the roller housing 20. Each side member 21, 22 further includes at least one aperture 24 for receiving a bearing and fastener 25, 28 extending therethrough to rotatably secure a roller or wheel to the roller housing (FIGS. 5 and 10).

As further shown in FIG. 5, at least one roller or wheel 30 is mounted within and generally surrounded by the roller housing. Each roller includes an outer groove or recess 31 about a circumference of the roller to engage a track or rail. In one or more embodiments, roller 30 may have an inner groove (not shown) at an approximate midpoint within the outer groove about the circumference of the roller, where the inner groove is inset from the outer groove 31 and has a diameter less than a diameter of the outer groove. A typical roller has one point of contact with the track or rail at the approximate midpoint of the profile of the roller or wheel, which concentrates the load at one specific point. By contrast, the roller 30 of the present invention provides an outer groove defining the profile of the wheel or roller, which presents an additional point of contact between the roller and the track over that of the prior art, allowing for improved load distribution. In embodiments where the roller also includes an inner groove, the inner groove is inset at a predetermined distance from the outer groove 31, such that the roller wheel will contact the rail only along the outer groove throughout translation of the roller system along the rail or track, distributing the load outwardly. The inset inner groove acts to provide additional load relief by concentrating the load along multiple points of contact on the outer groove, as the inner groove does not contact the track or rail.

Figure 7:
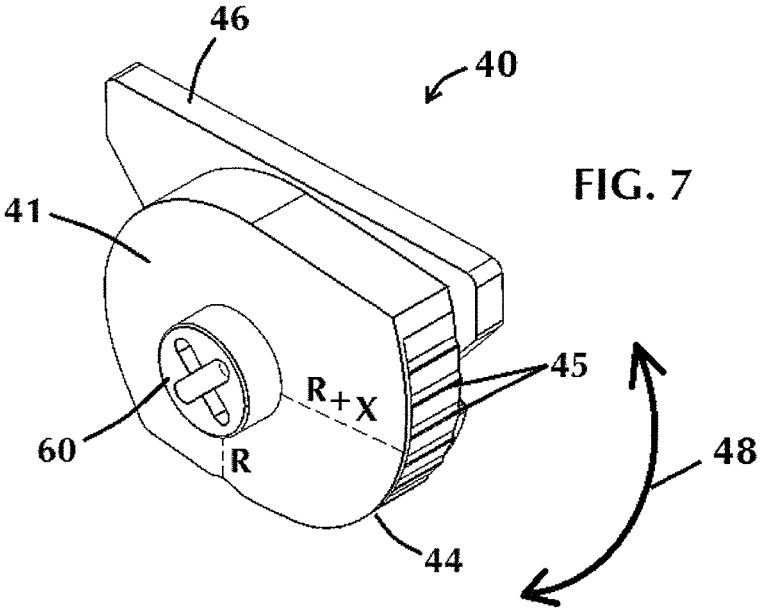
FIG. 7 is a perspective view of one embodiment of the height adjustment mechanism of the sliding door roller of the present invention.
Figure 8:
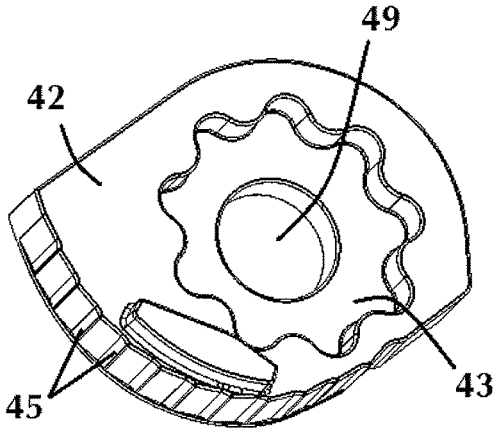
FIG. 8 is perspective view of the mating face of the cam shown in FIG. 7.
Figure 9:
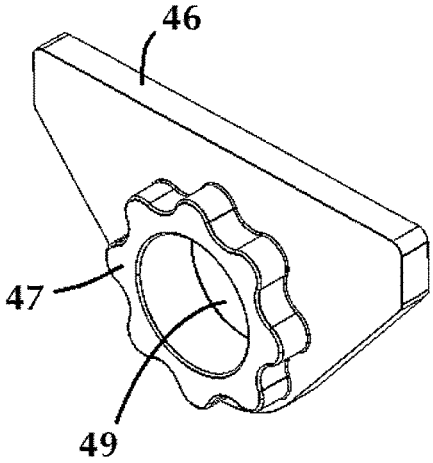
FIG. 9 is a perspective view of the mating face of the gear plate shown in FIG. 7.

Coupled to the outer housing or shell 10 and the inner roller housing 20 is a rotatable adjustment mechanism 40 for adjusting the height or spacing of the outer housing and panel with respect to the roller housing and rail or track. As shown in FIGS. 7-9, in one embodiment, the adjustment mechanism may comprise a non-circular cam 41 coupled to a gear plate 46 and rotatable about an axis transverse to the vertical side members of the roller housing, and a control member 60 which is in rotatable communication with the cam. Cam 41 includes a peripheral surface 44 having a plurality of teeth 45, wherein the peripheral surface defines an increasing radius R from a first position to a second position along the peripheral surface, when viewed in a counterclockwise direction (as shown in FIG. 7). In connection with the bump or projection 27 on the inner surface 26*a* of the roller housing base portion (FIGS. 4 and 10), the variable radius of the cam 41 and cam teeth 45 operates to index the outer housing 10 relative to the inner roller housing or carriage 20 in a plurality of height positions.

As shown in FIGS. 8 and 9, cam 41 has on a rear surface 42 a depression 43 within which gear wheel 47 is disposed, such that the cam is rotationally locked with the gear plate 46. Aperture 49 extends through both gear plate 46 and cam 41 for receiving control member 60 to adjust the height or spacing of the outer housing 10 with respect to the roller and track or rail.

A control member 60, such as a rotatable fastener, extends transversely through the sliding door roller for adjusting the height or spacing of the panel. More specifically, control member 60 extends through apertures 17 in outer housing vertical side members 11, 12, through the concave portion 23 of the inner housing vertical side members 21, 22, and through aperture 49 in the cam and gear plate, respectively, such that the control member may be side-adjusted or rotated from the exterior of either side of the outer housing 10 (FIG. 1). Adjustment of the control member, i.e., rotation of the fastener, rotates the cam 41 disposed within the roller housing in either a clockwise or counterclockwise direction (represented in FIG. 7 by arrow 48), such that the variable radius of the cam and cam teeth 45, in cooperation with the projection 27 at the base of the roller housing, operate to index the outer housing 10 relative to the inner roller housing 20 between desired height positions.

For example, rotation of the control member or fastener 60 in a clockwise direction (with reference to FIGS. 14A and 14B) rotates the cam 41 towards its increasing radii R+X (FIG. 7), thereby stepping or indexing the outer housing 20 away from the inner housing and increasing the height of the panel being supported with respect to the track. Conversely, rotation of the control member 60 in a counterclockwise direction will rotate the cam 41 towards its decreasing radii R, thereby bringing the inner housing and outer housing closer and decreasing the height of the outer housing (and panel) with respect to the track or rail. FIG. 14A shows the outer housing 10 in a fully lowered state (i.e., cam 41 is rotated completely in a counterclockwise direction) having a height H1, while FIG. 14B shows the outer housing in a fully extended state (i.e., cam 41 is rotated completely in a clockwise direction) having a height H2, which is greater than H1. In one embodiment, H1 may be about 1.5 inches (38.1 mm) and H2 may be about 1.75 inches (44.45 mm). It should be understood by those skilled in the art that the height differential between H1 and H2 may be greater than or less than 0.25 inches (6.35 mm), in accordance with manufacturing tolerances and design requirements. As the cam is rotated, control member 60 translates vertically up or down within channel 23 as the outer housing 10 is stepped away from or towards the rail or track, as shown in the transition from FIG. 14A to 14B. The rail or track is not shown in either FIG. 14A or 14B, for clarity.

When the adjustment mechanism 40 and control member 60 is not under rotation, bump or projection 27 on the inner surface 26*a* of the roller housing base portion acts as a detent to prevent the cam from rotating under the load of the panel. An advantage of the system of the present invention is that the height of the outer housing may be adjusted under the full load of the panel, rather than requiring removal of the panel and adjustment of the outer housing to meet a benchmark, as in prior art sliding roller systems.

It should be understood by those skilled in the art that a cam-style adjustment mechanism is only one means of adjusting the height of the outer housing in accordance with the present invention, and that other now-known or later-developed methods of adjustment, such as a screw and ramp configuration, are not precluded. An illustrative embodiment of a screw and ramp-type height adjustment mechanism is shown in FIGS. 15 to 16, depicting a pair of angled members 70, 72 having complementary ramped mating surfaces 74, 76, such that rotation in a first direction 62 of a fastener 60', such as a threaded screw, extending therebetween draws the members closer together to increase the height of the housing (FIG. 16B). As shown in FIGS. 15-16, fastener 60' is coupled to an internally threaded component 80 disposed within a recess (not shown) in a rear surface of member 72, such that component 80 causes angled member 72 to be drawn toward the top of ramped surface 74 of member 70 when fastener 60' is rotated in the first direction, thereby causing mating surfaces 74, 76 to cooperate to increase the height of the outer housing with respect to the inner roller housing (as similarly shown in FIG. 14B). Conversely, rotation of fastener 60' in a second, opposite direction lowers the outer housing with respect to the roller housing. It should be understood by those skilled in the art that the outer housing may be adjusted to any height between a fully-lowered and fully-extended position, in accordance with manufacturing tolerances and design requirements, and that the present invention is not limited to the extreme positions.

Figure 17:
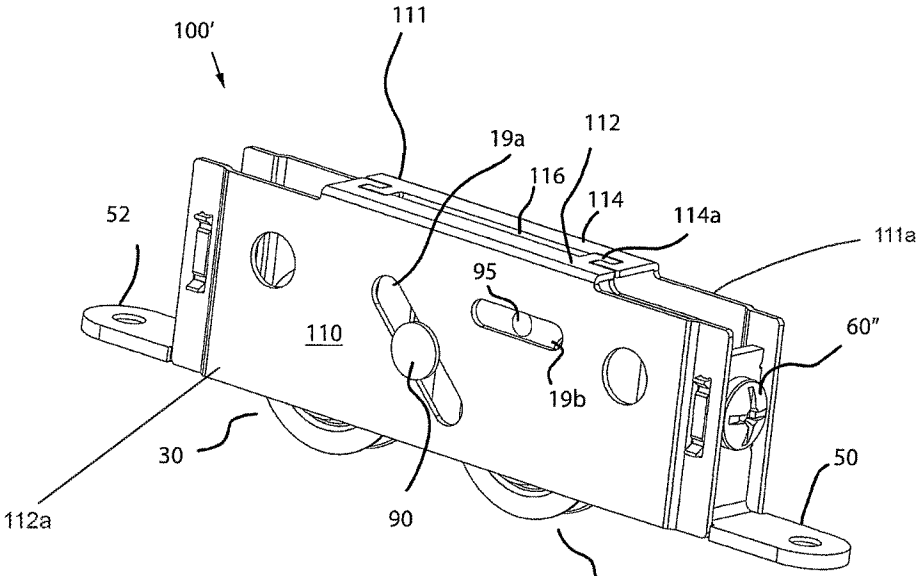
FIG. 17 is a perspective view of another embodiment of the sliding door roller of the present invention.
Figure 18:
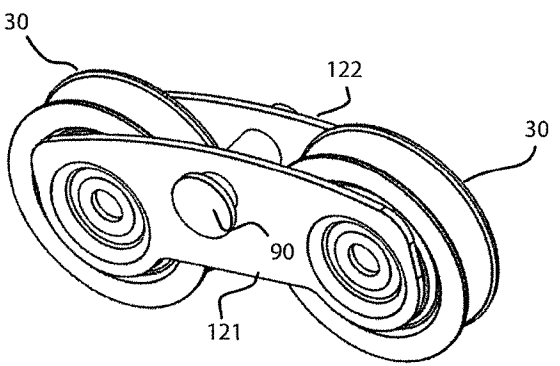
FIG. 18 is a perspective view of the roller housing of FIG. 17.
Figure 19:
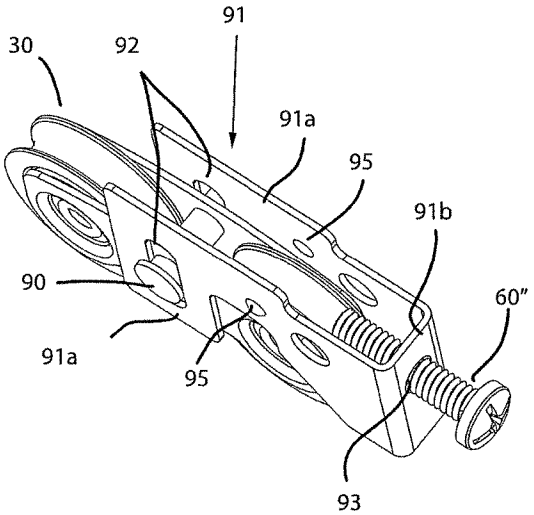
FIGS. 19 and 20 are top perspective, and side plan views, respectively, of the roller adjustment assembly of the sliding door roller in FIG. 17.
Figure 20:
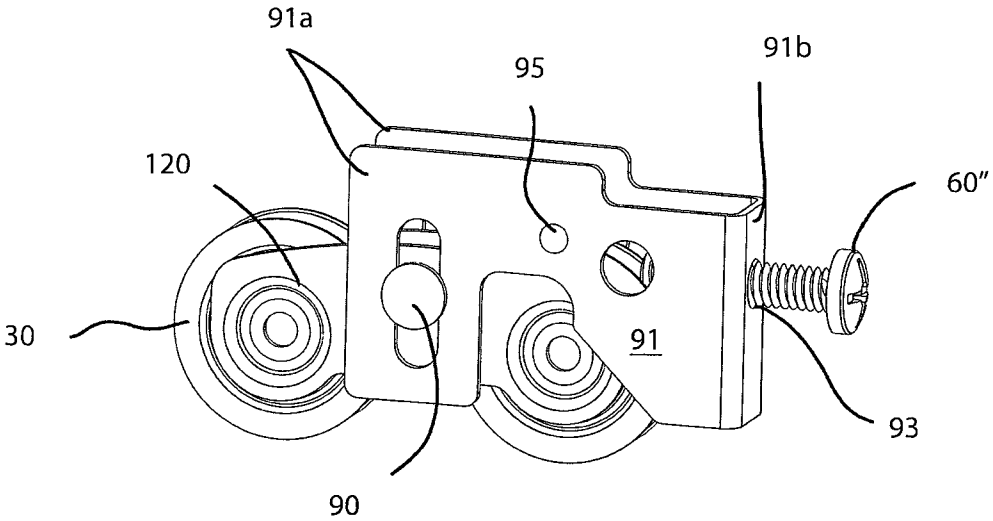

Turning now to FIGS. 17-22, another embodiment of the present invention is shown, having a height adjustment mechanism at an end of the roller assembly. Roller housing or carriage 120 may comprise a pair of generally vertical side members 121, 122 with an elongated shaft or member 90 extending approximately perpendicular between vertical side members 121, 122. As best shown in FIGS. 17 and 20, elongated member 90 extends through a roller adjustment housing 91 and the outer housing 110 through mating slots 19*a* positioned on the major faces of outer housing vertical shell members 111, 112.

Each shell member includes a flange 114 at a top edge 113 thereof that extends approximately perpendicular to the major surface 111*a*, 112*a* of each shell member in the direction of the opposing shell member. The flanges of the respective side members each have a keyed portion 114*a* or are otherwise interlocked to form a plane approximately perpendicular to the major surfaces of the respective shell members (FIG. 17). The plane formed by the interlocking flanges may comprise a slot or opening 116 approximately centered between the pair of vertical side members 111, 112. The interlocking flanges provide higher rigidity of the outer housing or shell, and increased load capacity over roller systems of the prior art, when a panel is secured thereto.

Slots 19*a* are oriented at an angle that is offset from a longitudinal axis of the outer housing 110. In an exemplary embodiment, as shown in FIG. 17, slot 19*a* is oriented at an approximately 45° angle to the housing longitudinal axis, however other angles are not precluded. Shell members 111, 112 further include a transverse slot 19*b* running parallel to the housing longitudinal axis.

Figure 21:
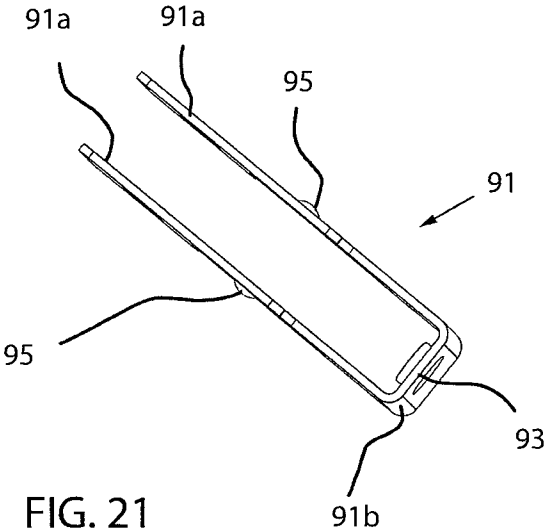
FIG. 21 is a top plan view of the roller adjustment housing of FIGS. 19 and 20.
Figure 22A:
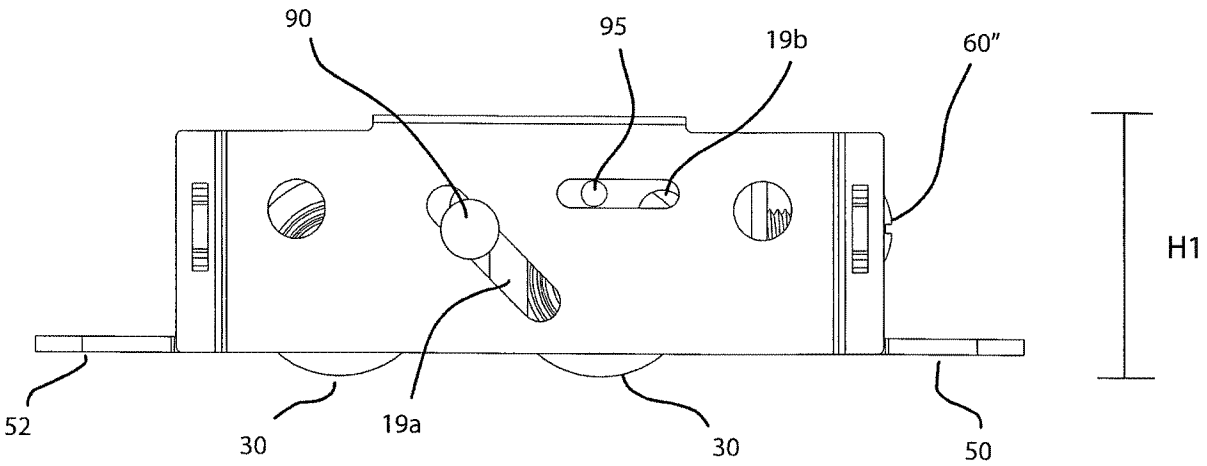
FIGS. 22A-22B are a side plan views of the embodiment of the sliding door roller assembly of FIG. 17, in a raised state (FIG. 22A) and a lowered stated (FIG. 22B).
Figure 22B:
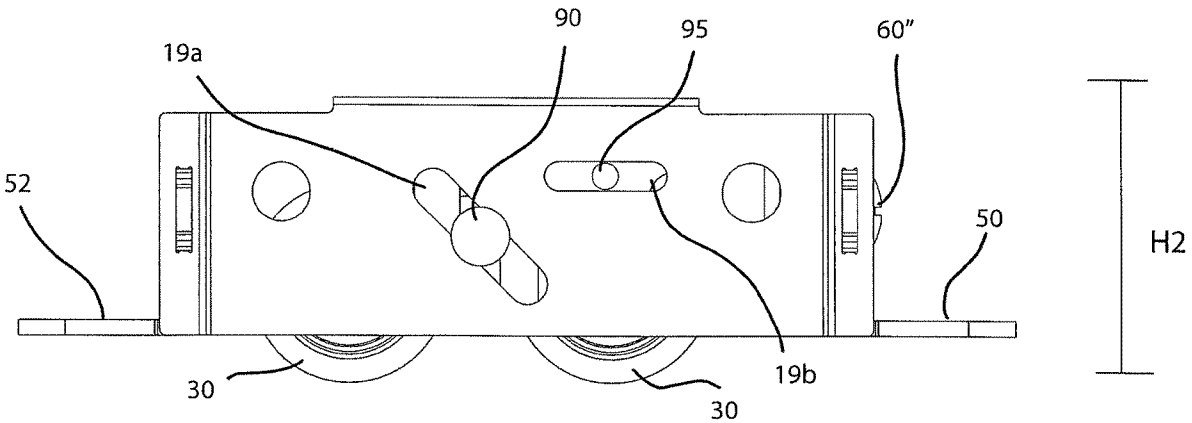

The roller adjustment housing 91 includes a pair of generally vertical side members 91*a* connected at one end to form the base of a "C" shape frame configuration 91*b* (as shown in FIGS. 19 and 20). As shown in FIG. 21, side members 91*a* are integral with a transverse member at one end form a "C" shape configuration, however it should be understood by those skilled in the art that in other embodiments a separate transverse member may be used to connect side members 91*a*. Disposed on each exterior face of side members 91*a* is a protrusion 95. When adjusting the height of the outer housing 110, protrusion 95 will traverse within slot 19*b* of outer housing 110 to prevent slipping or misalignment of roller adjustment housing 91 with respect to the shell members 111, 112, while shaft 90 traverses within vertically-oriented slot 92 of vertical members 91*a*. Located on base 91*b* is an opening 93 through which adjustment screw 60" extends along an axis perpendicular to shaft 90. Adjustment screw 60" is secured within the sliding door roller 100' through one end member 50, 52.

Rotation of adjustment screw 60" in one direction causes shaft 90 to traverse within slot 19*a*, increasing the height of the outer housing with respect to the inner roller housing (as similarly shown in FIG. 14B). Conversely, rotation of adjustment screw 60" in a second, opposite direction lowers the outer housing 111, 112 with respect to the roller housing 120. To prevent misalignment of the outer housing 110, roller housing 120, and roller adjustment housing 91, respectively, protrusion 95 traverses within slot 19*b* and is urged along a longitudinal axis. Simultaneously, shaft 90 traverses along the offset axis provided by slot 19*a* during height adjustment. It should be understood by those skilled in the art that the outer housing may be adjusted to any height between a fully-lowered and fully-extended position. The resulting combination allows for height adjustment of the roller housing 120 while sliding door roller 100' is within a panel routing from a terminal end of the panel. Outer housing 110 provides the structural support needed for height adjustment 120 of the sliding door roller 100' while under the full load of the panel.

Thus, the present invention achieves one or more of the following advantages. The roller system of the present invention allows for the adjustment of the height or spacing of the panel relative to the roller and rail or track while under full load of the panel, thereby eliminating the requirement of prior art roller systems that the door panel be removed and the height or spacing of the housing adjusted before replacing the door panel and comparing the new door position to a predetermined to a predetermined benchmark. The present invention further allows for higher load capability, as a result of the interlocking or keyed flanges connecting the outer housing or shell, and better load distribution at the roller or wheel due to the outer and inset inner roller groove configuration. The roller assembly of the present invention further simplifies manufacture and reduces installation time by replacing conventional tab screws with resilient members, such as spring clips, to engage the backside of the profile wall after the roller is installed into the bottom sash routing. As such, the assembly does not need to be installed horizontally at a perfect 90-degree angle to the vertical Z-axis of the panel and respective angular movement of the roller assembly from the perpendicular direction is allowed to some degree. Moreover, the opposing spring clips serve to automatically center the roller assembly within the routing during installation.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A sliding door roller comprising:

a roller housing comprising a pair of generally vertical side members, the roller housing at least partially disposed within an outer housing;

at least one roller wheel rotatably coupled to the roller housing;

the outer housing moveable relative to the roller housing and the at least one roller wheel, the outer housing moveable in a direction perpendicular to a rotational axis of the at least one roller wheel;

at least one resilient member at an end of the outer housing, the at least one resilient member including a fixed termination section coupled to an end member of the outer housing, a compliant section extending from the fixed termination section, a curved engagement section for mating with an inner surface of a slot defining a bottom edge of a panel secured to the outer housing, and a resilient section between the compliant section and the curved engagement section and pivotable about the compliant section, the at least one resilient member being flexible from a first position to a second position when the curved engagement section mates with an inner surface of the slot to provide a holding force between the resilient member and the inner surface of the slot to maintain the roller within the slot; and a rotatable adjustment mechanism coupled to the roller housing and the outer housing, the adjustment mechanism rotatable from an exterior of the outer housing and adapted to adjust a height of the outer housing relative to the roller housing in a plurality of height positions in situ under load of the panel.

2. The sliding door roller of claim 1 wherein the at least one resilient member includes a lip extending from the fixed termination section for coupling the resilient member to a first recessed portion of the end member of the outer housing, and a resilient flange angled toward the compliant section for coupling the resilient member to a second recessed portion of the end member of the outer housing.

3. The sliding door roller of claim 1 wherein the at least one resilient member resilient section extends from the compliant section at an approximately 45-degree angle when the at least one resilient member is in the first position.

4. The sliding door roller of claim 1 wherein the adjustment mechanism comprises a rotatable control member and a non-circular cam coupled to a gear wheel, the cam in rotatable communication with the control member and rotatable about an axis transverse to the roller housing vertical side members, the cam having a peripheral edge comprising a plurality of teeth, the cam teeth cooperating with a projection on an inner surface of a base portion of the roller housing to index the outer housing relative to the roller housing in a plurality of height positions as a result of rotation of the cam.

5. The sliding door roller of claim 4 wherein the cam peripheral edge defines an increasing radius from a first position along the cam peripheral edge to a second position along the cam peripheral edge, wherein rotation of the cam from about the first position towards the second position indexes the outer housing away from the inner housing; and wherein rotation of the cam from about the second position towards the first position indexes the outer housing towards the inner housing.

6. The sliding door roller of claim 4 wherein the roller housing inner surface projection acts as a detent to prevent rotation of the cam while under load of the panel.

7. The sliding door roller of claim 4 wherein the roller housing comprises a vertical channel extending through a portion of each side member, the adjustment mechanism control member extending between the side members and translatable within the channel as the outer housing is indexed relative to the roller housing as a result of rotation of the cam.

8. The sliding door roller of claim 1 wherein the outer housing comprises a pair of generally vertical shell members, and the adjustment mechanism rotatable control member extends through apertures in the respective major surfaces of the vertical shell members, the control member rotatable from an exterior of the outer housing to rotate the cam and gear wheel to index the outer housing relative to the roller housing.

9. The sliding door roller of claim 1 wherein the outer housing comprises a pair of generally vertical shell members, each shell member having a flange on an upper edge thereof extending in the direction of the opposing shell member, at least a portion of the shell member flanges being keyed or interlocking to form a plane perpendicular to respective major surfaces of the vertical shell members.

10. The sliding door roller of claim 9 further comprising a slot between the vertical shell member interlocking flanges and extending along a portion of a longitudinal axis of the outer housing.

11. The sliding door roller of claim 1 further including a substantially planar flange extending from the resilient member curved engagement section in a direction away from the fixed termination section.

12. The sliding door roller of claim 1 wherein the adjustment mechanism comprises a rotatable control member extending through a pair of angled members having complementary ramped mating surfaces disposed within the outer housing, the rotatable control member coupled to an internally threaded component disposed within a recess in a rear surface of one of the angled members, such that the internally threaded component causes said angled member to be drawn toward the opposing angled member when the rotatable control member is rotated in a first direction, the complementary mating surfaces cooperating to translate the outer housing relative to the roller housing in a plurality of height positions as a result of rotation of the control member.

13. A method of assembling a sliding door roller to a panel, comprising the steps of:

providing a sliding door roller assembly comprising:

a roller housing comprising a pair of generally vertical side members, the roller housing at least partially disposed within an outer housing;

at least one roller wheel rotatably coupled to the roller housing;

the outer housing moveable relative to the roller housing and the at least one roller wheel, the outer housing moveable in a direction perpendicular to a rotational axis of the at least one roller wheel;

at least one resilient member at an end of the outer housing, the at least one resilient member including a fixed termination section coupled to an end member of the outer housing, a compliant section extending from the fixed termination section, a curved engagement section, and a resilient section between the compliant section and the curved engagement section and pivotable about the compliant section, the at least one resilient member being flexible from a first position to a second position; and a rotatable adjustment mechanism coupled to the roller housing and the outer housing, the adjustment mechanism rotatable from an exterior of the outer housing and adapted to adjust a height of the outer housing relative to the roller housing in a plurality of height positions in situ under load of a panel;

providing the panel having a bottom edge defining a routing for the sliding door roller assembly, the routing including a slot having an inner surface with opposing edges;

inserting the sliding door roller within the panel slot to mate the curved engagement section of the sliding door roller at least one resilient member with one of the slot inner surface opposing edges;

while inserting, causing the at least one resilient member to flex from the first position to the second position to generate a holding force between the resilient member and the inner surface of the slot in a direction transverse to an axial insertion direction of the sliding door roller assembly; and releasing the sliding door roller assembly so that the holding force acts on the resilient member to maintain the sliding door roller assembly within the panel routing.

14. The method of claim 13 wherein the step of inserting the sliding door roller within the panel slot comprises:

permitting limited misalignment of the sliding door roller assembly on an axis perpendicular to a longitudinal axis of the panel.

15. The method of claim 13 wherein the step of flexing the at least one resilient member from the first position to the second position further comprises:

moving the at least one resilient member curved engagement section in a direction which is substantially perpendicular to a longitudinal axis of the resilient member; and causing the resilient section to pivot about the compliant section.

16. The method of claim 13 further including:

rotating the adjustment mechanism from the exterior of the outer housing to translate the outer housing relative to the roller housing from a first height position to a second height position, the second height position being different from the first height position.

17. The method of claim 13 wherein the adjustment mechanism comprises a rotatable control member and a non-circular cam coupled to a gear wheel, the cam in rotatable communication with the control member and rotatable about an axis transverse to the roller housing vertical side members, the cam having a peripheral edge comprising a plurality of teeth, the cam teeth cooperating with a projection on an inner surface of a base portion of the roller housing to index the outer housing relative to the roller housing in a plurality of height positions as a result of rotation of the cam, and wherein the step of rotating the adjustment mechanism further comprises:

rotating the control member and cam to index the outer housing relative to the roller housing.

18. The method of claim 17 wherein the cam peripheral edge defines an increasing radius from a first position along the cam peripheral edge to a second position along the cam peripheral edge, wherein rotation of the cam from about the first position along the cam peripheral edge towards the second position along the cam peripheral edge indexes the outer housing away from the inner housing to the second height position, the second height position being greater than the first height position; and wherein rotation of the cam from about the second position along the cam peripheral edge towards the first position along the cam peripheral edge indexes the outer housing towards the inner housing to the second height position, the second height position being lower than the first height position.

19. The method of claim 17 wherein the roller housing inner surface projection acts as a detent to prevent rotation of the cam while under load of the panel, and further comprising the step of:

locking the outer housing in a desired height position relative to the roller housing by engaging one or more of the cam teeth with the roller housing inner surface projection.

20. The method of claim 13 wherein the adjustment mechanism comprises a rotatable control member extending through a pair of angled members having complementary ramped mating surfaces disposed within the outer housing, the rotatable control member coupled to an internally threaded component disposed within a recess in a rear surface of one of the angled members, such that the internally threaded component causes said angled member to be drawn toward the opposing angled member when the rotatable control member is rotated in a first direction, the complementary mating surfaces cooperating to translate the outer housing relative to the roller housing in a plurality of height positions as a result of rotation of the control member, and wherein the step of rotating the adjustment mechanism further comprises:

causing the one of the angled members to be drawn toward a top of the mating ramped surface of the opposing angled member to translate the outer housing relative to the roller housing.

* * * * *